US006398668B1

(12) United States Patent
Wai

(10) Patent No.: US 6,398,668 B1
(45) Date of Patent: Jun. 4, 2002

(54) GOLF BALL WITH AN OXYGEN BARRIER

(75) Inventor: Martin P. Wai, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 71 days.

(21) Appl. No.: 09/632,667

(22) Filed: Aug. 7, 2000

(51) Int. Cl.[7] ..... A63B 37/06
(52) U.S. Cl. ..... 473/374
(58) Field of Search ..... 473/370, 367, 473/371, 373, 374, 376

(56) References Cited

U.S. PATENT DOCUMENTS 697,424 A 4/1902 Kempshall
4,919,434 A * 4/1990 Saito ..... 473/374
4,998,734 A * 3/1991 Meyer ..... 473/370
5,730,665 A 3/1998 Shimosaka et al.
5,820,488 A * 10/1998 Sullivan et al. ..... 473/374
5,836,833 A 11/1998 Shimosaka et al.

* cited by examiner

*Primary Examiner*—Mark S. Graham
*Assistant Examiner*—Raeann Gorden
(74) *Attorney, Agent, or Firm*—Michael A. Catania

(57) ABSTRACT

A golf ball having an oxygen barrier layer to protect an oxygen sensitive core is disclosed herein. The preferred oxygen barrier film is an EVOH film. The core is preferably polybutadiene and a cover is preferably polyurethane. The oxygen barrier film reduces the loss of resilience over time, and reduces the increase in compression of the golf ball over time.

8 Claims, 3 Drawing Sheets

GOLF BALL WITH AN OXYGEN BARRIER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a golf ball with an oxygen barrier layer to prevent oxidation of an oxygen sensitive core.

2. Description of the Related Art

The core of the golf ball is the "engine" for the golf ball such that the inherent properties of the core will strongly determine the initial velocity and distance of the golf ball, and to a lesser extent the spin and feel of the golf ball. A higher initial velocity will usually result in a greater overall distance for a golf ball. In this regard, the Rules of Golf, approved by the United States Golf Association ("USGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the core for a USGA approved golf ball is constructed to enable the golf ball to meet, yet not exceed, these limits.

The coefficient of restitution ("COR") is a measure of the resilience of a golf ball. The COR is a measure of the ratio of the relative velocity of the golf ball after direct impact with a hard surface to the relative velocity before impact with the hard surface. The COR may vary from 0 to 1, with 1 equivalent to a completely elastic collision and 0 equivalent to a completely inelastic collision. A golf ball having a COR value closer to 1 will generally correspond to a golf ball having a higher initial velocity and a greater overall distance. If the golf ball has a high COR (more elastic), then the initial velocity of the golf ball will be greater than if the golf ball had a low COR. In general, a lower Rhiele compression core will result in a higher COR value if the core is not degraded by oxidation.

The golf ball cores may be hollow, liquid filled or solid. Most solid cores are generally composed of a blend of a base rubber, a cross-linking agent, a free radical initiator, and one or more fillers or processing aids. A preferred base rubber is a polybutadiene having a high cis-1,4 content since the polybutadiene provides the desire COR for greater initial velocity.

However, polybutadiene and other base rubbers are highly susceptible to oxidation which changes the morphology of the polybutadiene that results in lower COR, increased Rhiele compression (the balls becomes softer), and possibly physical degradation of the material.

Ionomers and polyprolyene materials act as oxygen barriers, however, the thickness of these materials have adverse affects on the performance of a golf ball. For example, many golf balls have a polybutadiene core and a cover composed of a SURLYN® ionomer material. The thickness of the cover is usually 2 millimeters to 5 millimeters, and thus, greatly affects the performance of a golf ball. Ionomer materials are typically hard, on a Shore D scale, and have durability problems. Nevertheless, ionomer materials of this particular thickness do in fact provide an oxygen barrier for a polybutadiene core.

However, golfers demand golf balls with more than an ionomer cover on a polybutadiene core. Golfers want a durable cover, with a soft feel over a high energy core.

BRIEF SUMMARY OF THE INVENTION

The present invention is able to overcome the problems of the prior art by providing a golf ball with an oxygen susceptible core, an oxygen permeable cover, and an oxygen barrier layer juxtaposed by the core and the cover. The oxygen barrier layer is preferably a thin film of ethylene vinyl alcohol copolymer which does not affect the performance of the golf ball, and is mechanically strong to withstand the manufacturing process for the golf ball.

One aspect of the present invention is a golf ball having a core, an oxygen barrier layer and a cover. The core is composed of polymer that is susceptible to oxidation. The oxygen barrier layer encompasses the core and has a thickness of less than 1 millimeter. The cover encompasses the oxygen barrier layer and is composed of an oxygen permeable material.

Another aspect of the present invention is golf ball having a polybutadiene core, an oxygen barrier film, and a polyurethane cover. The polybutadiene core has a diameter that ranges from 30 millimeters to 40 millimeters. The oxygen barrier film encompasses the core has a thickness of less than 1 millimeter and is composed of an ethylene vinyl alcohol copolymer. The cover encompasses the oxygen barrier film and has a thickness in the range of 0.5 millimeters to 3.5 millimeters. The cover may be thermosetting polyurethane, thermoplastic polyurethane, or other similar materials such as HYLENE®, PEBAX® and HYTREL®. The cover may be manufactured by injection molding, compression molding or casting.

Another aspect of the present invention is a method for producing a golf ball with an oxygen permeable cover. The method includes encompassing a core slug of an oxygen susceptible material within at least one sheet of an oxygen barrier film. The method also includes placing the core slug and oxygen barrier film within a mold and molding the core slug into a spherical core encompassed within the oxygen barrier film. The method also includes covering the spherical core and oxygen barrier film with a cover composed of an oxygen permeable material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
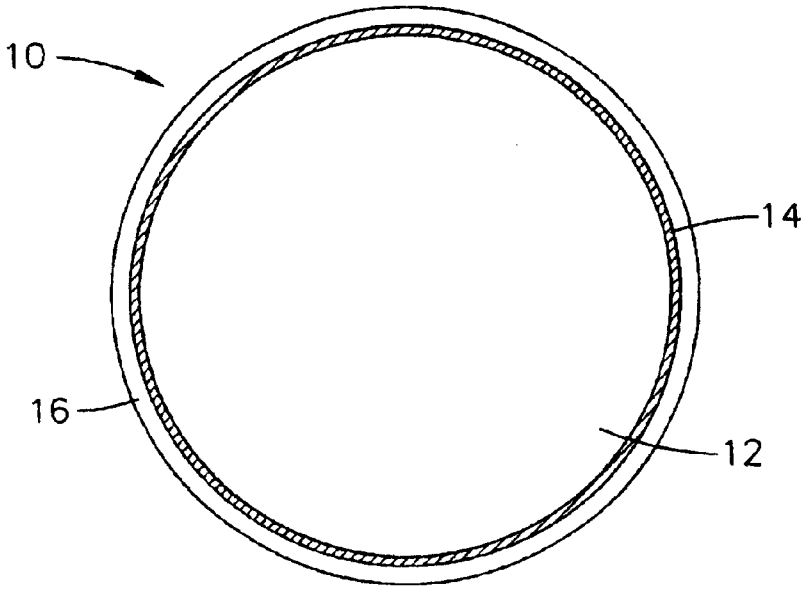
FIG. 1 is a cross-sectional view of a golf ball of the present invention.
Figure 2:
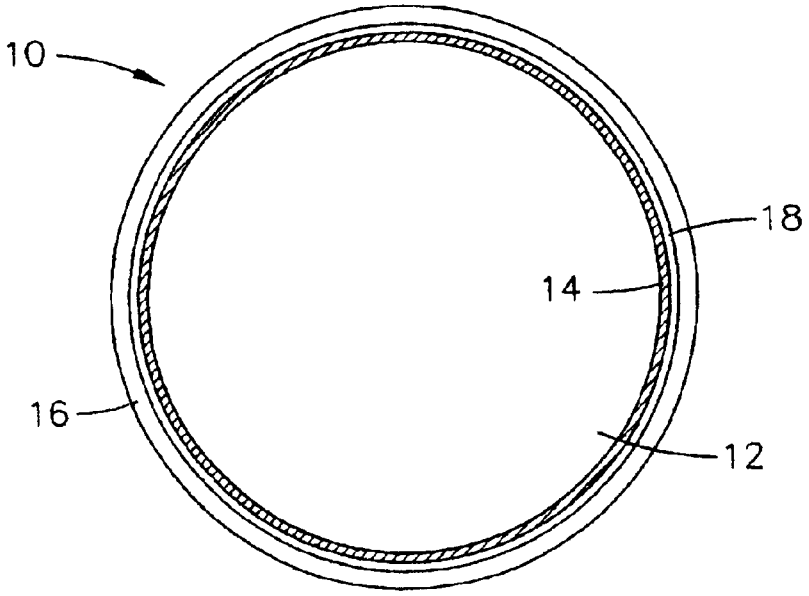
FIG. 2 is a cross-sectional view of an alternative golf ball of the present invention.

As shown in FIG. 1, a golf ball of the present invention is generally designated 10. The golf ball 10 has a core 12, an oxygen barrier layer 14 and a cover 16. An alternative embodiment is shown in FIG. 2 in which an intermediate layer 18 is juxtaposed by the oxygen barrier layer 14 and the cover 16. In a preferred embodiment, the golf ball has a diameter of 42 millimeters (1.68 inches), however alternative embodiment may be larger or smaller in diameter. The core 12 of the golf ball 10 is generally composed of a blend of a base elastomer, a cross-linking agent, a free radical initiator, and one or more fillers or processing aids. A preferred base elastomer is a polybutadiene having a cis-1,4 content above 90%, and more preferably 98% or above. However, those skilled in the relevant art will recognize that other elastomers such as natural or synthetic rubber may be used for the core material without departing from the scope and spirit of the present invention. Polybutadiene, natural rubbers, synthetic rubbers and similar elastomers are all susceptible to oxidation.

The use of cross-linking agents in a golf ball core material is well known, and metal acrylate salts are examples of such cross-linking agents. Metal salt diacrylates, dimethacrylates, or mono(meth)acrylates are preferred for use in the golf ball core materials, and zinc diacrylate is a particularly preferred cross-linking agent. Other metal salt di- or mono- (meth) acrylates suitable for use in the core material include those in which the metal is calcium or magnesium. In the manufacturing process it may be beneficial to pre-mix some cross-linking agent(s), such as, e.g., zinc diacrylate, with the polybutadiene in a master batch prior to blending with other core material components.

Free radical initiators are used to promote cross-linking of the base elastomer and the cross-linking agent. Suitable free radical initiators for use in the golf ball core material include peroxides such as dicumyl peroxide, bis-(t-butyl peroxy) diisopropyl benzene, t-butyl perbenzoate, di-t-butyl peroxide, 2,5-dimethyl-2,5-di-5-butylperoxy-hexane, 1,1-di (t-butylperoxy) 3,3,5-trimethyl cyclohexane, and the like, all of which are readily commercially available. The amount of free radical initiator will affect the curing of the core material.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available.

The material for the core 12 may be mixed in mixing chamber and then aged for a predetermined amount of time. The material for the core 12 is allowed aged in an open air environment. However, oxidation is not of concern at this time because the material components are still in a dynamic phase. The mixture is then formed into slugs for molding into spherical core using conventional compression molding techniques.

Table One below provides the ranges of materials included in the preferred core formulations of the core 12 of the golf ball 10 of the present invention.

TABLE 1

| Core Formulations | | |
|---|---|---|
| Component | Preferred Range | Most Preferred Range |
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler (e.g. tungsten) | As desired (e.g. 2–10 phr) | As desired (e.g. 2–10 phr) |

In a preferred form, the finished core 12 has a diameter of about 34 mm (1.34 inches) to about 41.65 mm (1.64 inches) for a golf ball 10 having an outer diameter of 42.67 mm (1.68 inches). Preferably, the diameter of the core 12 is 37.82 mm (1.489 inches) or 38.48 mm (1.515 inches). The weight of the core 12 is preferably maintained in the range of about 32 grams to about 40 grams. The PGA compression of the core 12 is preferably maintained in the range of about 50 to 90 points, more preferably about 55 to 80 points, and most preferably 60 to 75 points. The weight of the golf balls 10 varies from 45.65 grams to 45.92 grams. The PGA compression of the golf balls 10 varies from 92 to 101. The average diameter of each of the golf balls 10 is consistently 1.684 inches. The PGA compression of the cores 12 varies between 60 and 75 points.

As used herein, the term "PGA compression" is defined as follows:

PGA compression value=180—Riehle compression value

The Riehle compression value is the amount of deformation of a golf ball in inches under a static load of 200 pounds, multiplied by 1000. Accordingly, for a deformation of 0.075 inches under a load of 200 pounds, the Riehle compression value is 75 and the PGA compression value is 105. A higher PGA compression indicates that the core or golf ball is harder or less compressive whereas a lower value indicates that the golf ball or core is softer or more compressive. Oxidation of an elastomer core will lower the Rhiele compression thereby creating a softer golf ball with less resilience (a lower COR) because the perimeter of the polybutadiene core becomes degraded and susceptible to cracking.

To prevent oxidation of the core 12, the golf ball 10 of the present invention has an oxygen barrier layer 14, most preferably in the form of a thin film the encompasses the core 12. The thinner the film 14, the less affect on performance of the golf ball. The oxygen barrier layer 14 must been sufficiently impermeable to oxygen, have a sufficient mechanical strength for manufacturing, and have a maximum thickness that does not interfere with manufacturing or performance of the golf ball 10. The thickness of the oxygen barrier film ranges from 0.001 mm to 1.000 mm, preferably from 0.005 mm to 0.200 mm, and more preferably from 0.010 mm to 0.025 mm. A preferred thickness is 0.012 mm (0.0005 inch). The oxygen transmission rate at 20° C. and 85% relative humidity should be below 0.50 cubic centimeters per 100 square inches ("cc/100 in$^2$") for 24 hours at one atmosphere of pressure. Preferably, the oxygen transmission rate is lower than 0.25 cc/100 in$^2$ for 24 hours at one atmosphere of pressure, and most preferably the oxygen transmission rate is lower than 0.10 cc/100 in$^2$ for 24 hours at one atmosphere of pressure.

TABLE TWO

| Item | Unit | Ex. 1 | Ex. 2 | Ex. 3 | LDPE | PET | PVA |
|---|---|---|---|---|---|---|---|
| Thickness | $\mu$ | 15 | 15 | 20 | 50 | 12 | 14 |
| Tensile Strength (breaking) - MD | p.s.i. | 29,900 | 12,800 | 10,000 | 2,800 | 22,800 | 24,200 |
| Tensile Strength (breaking) - TD | p.s.i. | 28,400 | 5,700 | 5,700 | 2,800 | 27,000 | 27,000 |
| Elongation - MD | % | 100 | 180 | 260 | 340 | 140 | 70 |
| Elongation - TD | % | 100 | 140 | 190 | 600 | 60 | 60 |
| Young's Modulus - MD | p.s.i. | 512,000 | 313,000 | 256,000 | 21,000 | 498,000 | 583,000 |
| Young's Modulus - TD | p.s.i. | 484,000 | 313,000 | 256,000 | 23,000 | 569,000 | 612,000 |
| Water vapor transmission rate | g/100 in$^2$., 24 hrs | 3 | 6 | 2 | 1 | 3 | 71 |
| Oxygen Transmission Rate - 35 C. 0% RH | cc/100 in$^2$., 24 hrs | 0.03 | 0.03 | 0.21 | 387 | 12.90 | 0.02 |
| Oxygen Transmission Rate - 20 C, 65% RH | | 0.02 | 0.03 | 0.10 | 174 | 5.81 | 0.16 |
| Oxygen Transmission Rate - 20 C, 85% RH | | 0.07 | 0.13 | 0.21 | 174 | 5.81 | 0.90 |
| Oxygen Transmission Rate - 20 C, 100% RH | | 0.39 | 1.61 | 0.65 | 174 | 5.81 | 38.71 |

A preferred oxygen barrier layer 14 is a thin film of an ethylene vinyl alcohol copolymer ("EVOH"). The EVOH film may be bi-axially oriented or it may be non-oriented. Such a film is commercially available from the EVAL Company of America, Lisle, Ill., under the trade name EVAL® film. Table Two illustrates the properties of the various EVAL films (as Ex. 1, Ex. 2 and Ex. 3) compared to low density polyethylene ("LDPE"), polyethylene terephthlate ("PET") and polyvinyl acetate ("PVA").

The tensile strength, elongation and Young's Modulus were measured at 20° C. and 65% relative humidity using the American Standard Testing Measurement ("ASTM") D882. The water vapor transmission rate was measured at 40° C. and 90% relative humidity using the Japanese testing measuring method JIS Z 0208. The oxygen transmission rate was measured at various temperatures and relative humidity using the ASTM D3985 measuring method.

The cover 16 of the golf ball 10 of the present invention is preferably composed of a polyurethane material. The polyurethane material may be thermoplastic or thermosetting. Preferably, the polyurethane embodied in the present invention is a thermosetting polyurethane such as disclosed in co-pending U.S. patent application Ser. No. 09/295635, filed on Apr. 20, 1999, or co-pending U.S. patent application Ser. No. 09/361912, filed on Jul. 27, 1999, both of which pertinent parts are hereby incorporated by reference. The cover 16 has a thickness of 0.5 mm to 5.0 mm, preferably 0.75 mm to 3.00 mm, and most preferably 1.0 mm to 2.0 mm.

A polyurethane cover 16 provides durability and a soft feel. However, polyurethane has a very high oxygen transmission rate. Thus, the oxygen barrier layer 14 compensates for the high oxygen transmission rate of the polyurethane cover 16. The cover 16 may also be composed of materials such as block copolymers, other elastomers, balata, and the like. In the alternative embodiment, the intermediate layer 18 may be a material similar to the cover 16, or a harder material such as a thermoplastic material.

Figure 3:
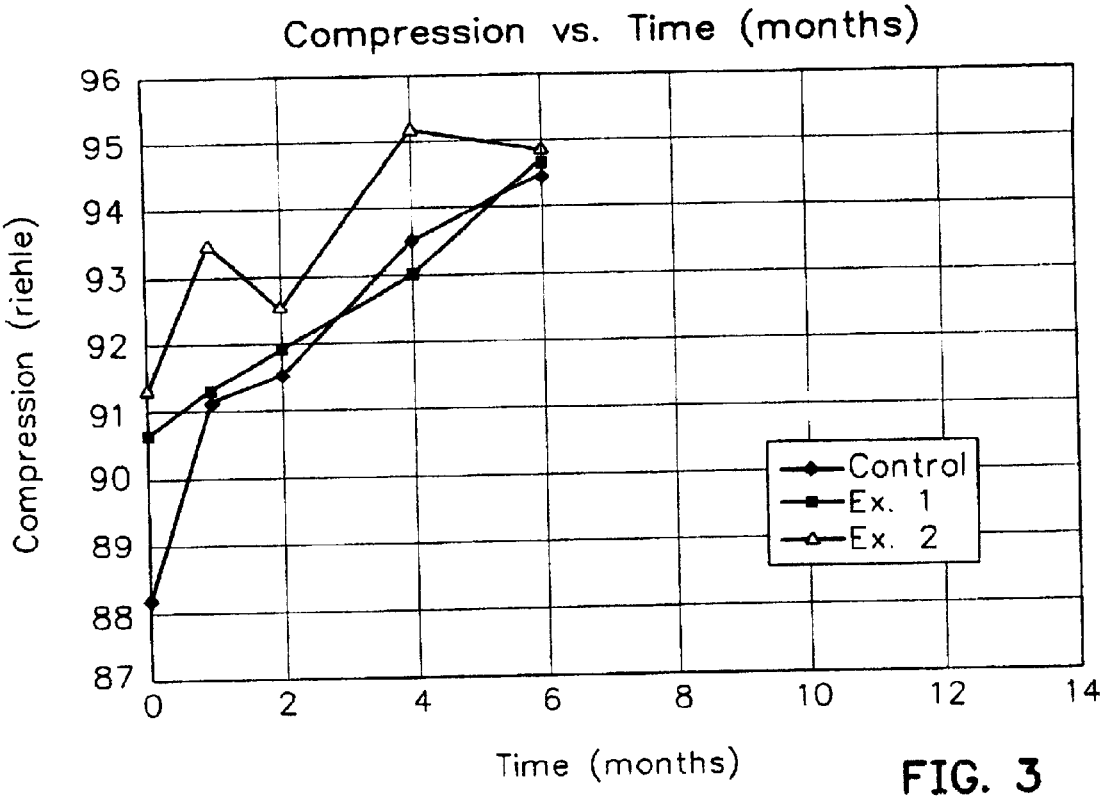
FIG. 3 is a graph of the compression versus time.
Figure 4:
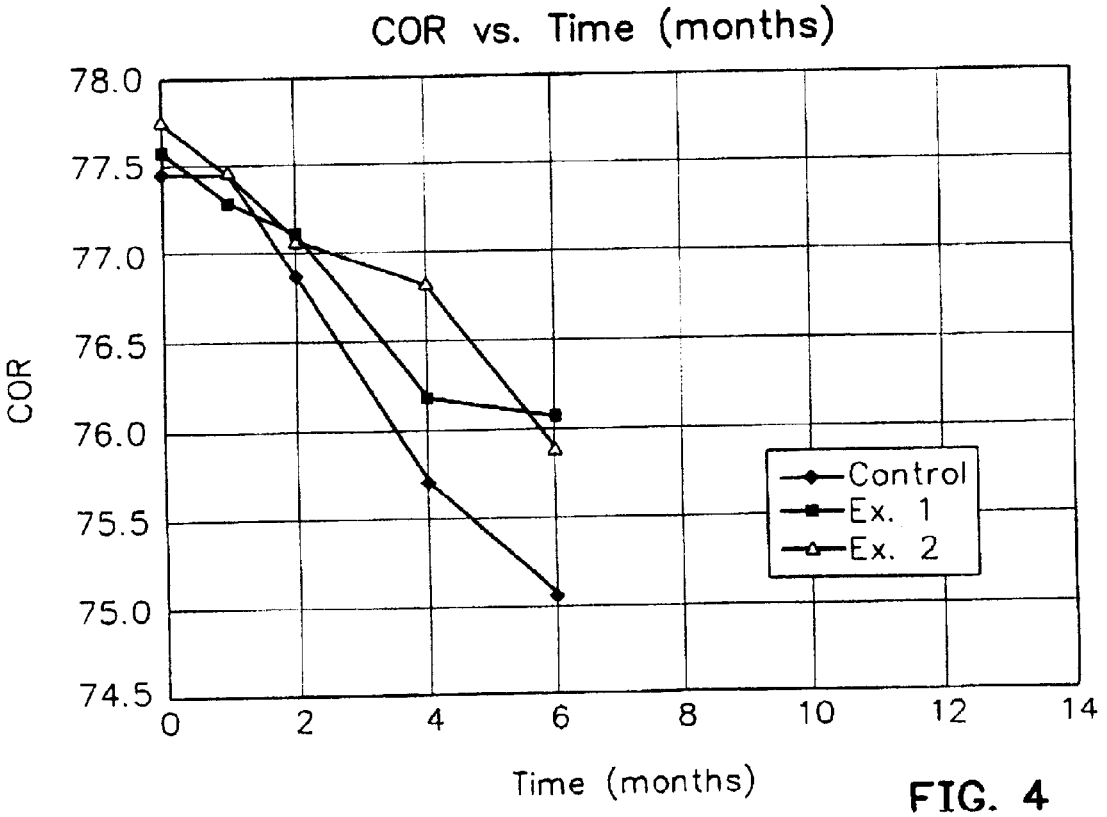
FIG. 4 is a graph of the COR versus time.
Figure 5:
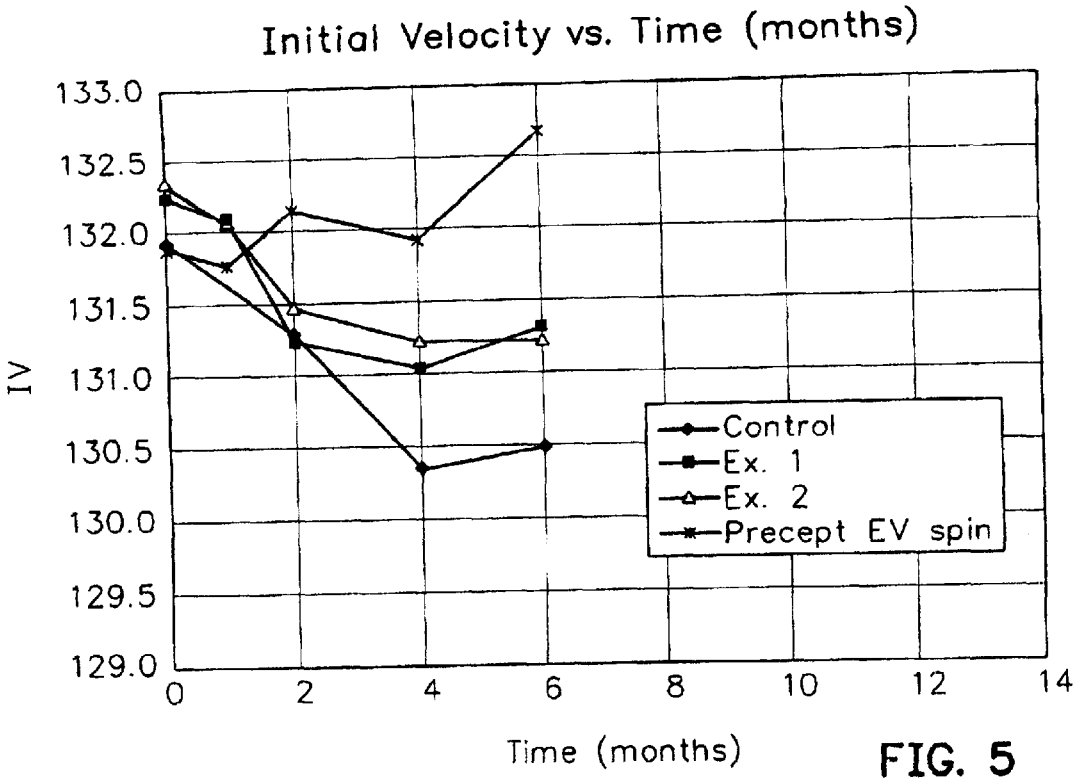
FIG. 5 is a graph of the initial velocity versus time.

FIGS. 3–5 illustrate the oxygen barrier properties of the golf ball 10 of the present invention as compared to a control golf ball. Three sets of golf balls were compared over a six month period for compression, COR and initial velocity. Each set had six golf balls, and the average of the set was used as the value for each test.

The first set of golf balls, Ex. 1, each had a non-oriented EVOH film having a thickness of approximately 0.012 mm. The film was wrapped around a core composed of polybutadiene, zinc diacrylate, zinc stearate, tungsten and peroxide. The core had a diameter of 39.47 mm, and had a specific gravity of 1.118 g/cc. The Ex. 1 golf balls had covers composed of a thermosetting polyurethane that was comprised of a para-phenylene diisocyanate polyether terminated prepolymer, a para-phenylene diisocyanate polyester terminated prepolymer, and a toluene diisocyanate polyehter terminated prepolymer. The thickness of the cover was 3.075 mm.

The second set of golf balls, Ex. 2, each had a bi-axially oriented EVOH film having a thickness of 0.012 mm. The film was wrapped around a core composed of polybutadiene, zinc diacrylate, zinc stearate, tungsten and peroxide. The core had a diameter of 39.54 mm, and had a specific gravity of 1.118 g/cc. The Ex. 2 golf balls had covers composed of a thermosetting polyurethane that was comprised of a para-phenylene diisocyanate polyether terminated prepolymer, a para-phenylene diisocyanate polyester terminated prepolymer, and a toluene diisocyanate polyehter terminated prepolymer. The thickness of the cover was 2.99 mm.

The third set, the control golf balls, only had a core and a cover. The core was composed of polybutadiene, zinc diacrylate, zinc stearate, tungsten and peroxide. The core had a diameter of 39.5 mm, and had a specific gravity of 1.118 g/cc. The control golf balls had covers composed of a thermosetting polyurethane that was comprised of a para-phenylene diisocyanate polyether terminated prepolymer, a para-phenylene diisocyanate polyester terminated prepolymer, and a toluene diisocyanate polyether terminated prepolymer. The thickness of the cover was 3.17 mm.

As shown in FIG. 3, the Riehle compression of the control balls increased 6.5 points over a six month period, and thus the golf balls became softer over the six month period. The Ex. 1 golf balls only increased four points over the same six month period. The Ex. 2 golf balls only increased three points over the six month period.

As shown in FIG. 4, the COR of the golf balls over the six month period showed even greater variance between the control golf balls and the golf balls of the present invention. The control golf balls dropped 2.5 points over the six month period. The Ex. 1 golf balls and the Ex. 2 golf balls of the present invention only dropped 1.5 points in COR over the six month period.

As shown in FIG. 5, the golf balls of the present invention retained a greater initial velocity than the control golf balls.

Figure 6:
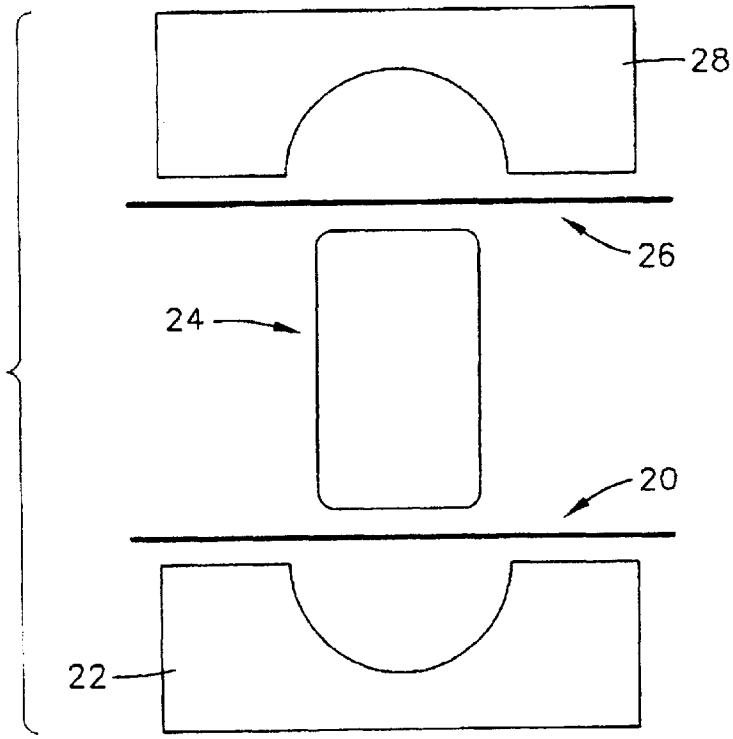
FIG. 6 is a schematic view of the compression molding of the core and oxygen barrier layer.

The method for manufacturing the golf ball 10 of the present invention includes first mixing the core 12 material within a mixing chamber and allowing the mixture to age. Then, the mixture is formed into slugs. At a compression molding unit, a first sheet 20 of the oxygen barrier layer 14 is placed within a first spherical mold half 22 as shown in FIG. 6. Then, a slug 24 is placed within the first mold half 22. Next, a second sheet 26 is placed within a second mold half 28. The mold halves 22 and 28 are mated and the slug 24 and sheets 20 and 26 are subjected to compression molding at a high pressure and a high temperature for at least 60 seconds to form an oxygen barrier layer 14 about the core 12. The core is then subjected to finishing to remove any flange. The oxygen barrier layer 14 retains its structure due to the mechanical strength and elongation of the material. Alternatively, the oxygen barrier layer may be sprayed on a finished core by placing the core in a rotating spindle, and coating the core with a liquid phase of the oxygen barrier material for a sufficient period to obtain the desired thickness.

Next, the core 12 with oxygen barrier layer 14 thereon is inserted into a casting mold half filled with a partially gelled polyurethane pre-mixture. A second casting mold half filled with partially gelled polyurethane pre-mixture is mated with the first casting mold half, and a polyurethane cover 16 is cast over the core 12 and oxygen barrier layer 14. Such a casting procedure is described in co-pending U.S. patent application Ser. No. 09/496,126 which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising:

a core composed of polybutadiene material, the core having a diameter that ranges from 30 millimeters to 40 millimeters;

an oxygen barrier film encompassing the core, the oxygen barrier having a thickness of less than 1 millimeter and composed of an ethylene vinyl alcohol copolymer;

a cover encompassing the oxygen barrier film, the cover composed of a polyurethane material, the cover having a thickness in the range of 0.5 millimeters to 3.5 millimeters; and an intermediate layer between the cover and the oxygen barrier film.

2. A method for producing a golf ball with an oxygen permeable cover, the method comprising:

encompassing a core slug of an oxygen susceptible material within at least one sheet of a oxygen barrier film;

placing the core slug and oxygen barrier film within a mold;

molding the core slug into a spherical core encompassed within the oxygen barrier film; and covering the spherical core and oxygen barrier film with a cover composed of an oxygen permeable material.

3. The method according to claim 2 wherein encompassing the core slug comprises:

placing a first sheet of an oxygen barrier film within a first mold half for a core;

placing a second sheet of the oxygen barrier film within a second mold half for the core; and placing the core slug within the first mold half.

4. The method according to claim 2 wherein the oxygen barrier film is composed of an ethylene vinyl alcohol copolymer.

5. The method according to claim 4 wherein the oxygen barrier film has an oxygen permeability of less than 2.0 cubic centimeters per 100 square inches over a 24 hour period at 1 atmosphere pressure, at 20° C. with 100% relative humidity.

6. The method according to claim 2 wherein the cover is composed of a polyurethane material.

7. The method according to claim 2 wherein the core is composed of a polybutadiene material.

8. The method according to claim 2 wherein molding comprises heating the core slug to a temperature greater than 100 Degrees Celsius at a pressure greater than 10 atmospheres.

* * * * *